United States Patent [19]

DeVigili et al.

[11] 4,350,365

[45] Sep. 21, 1982

[54] SKI BRAKING DEVICE

[75] Inventors: Walter J. DeVigili, Roseville; Louis E. Hough, St. Clair Shores, both of Mich.

[73] Assignee: Emprie Automotive, Inc., Roseville, Mich.

[21] Appl. No.: 195,879

[22] Filed: Oct. 10, 1980

[51] Int. Cl.[3] ..... A63C 9/10

[52] U.S. Cl. ..... 280/605; 188/6

[58] Field of Search ..... 280/604, 605; 188/5, 188/6, 7

[56] References Cited

U.S. PATENT DOCUMENTS 2,208,214 7/1940 Fortune ..... 280/605

2,316,252 4/1943 Karlsson ..... 280/605

4,234,207 11/1980 DeVigili ..... 280/605

*Primary Examiner*—Joseph F. Peters, Jr.

*Assistant Examiner*—Michael Mar

*Attorney, Agent, or Firm*—Barnes, Kisselle, Raisch & Choate

[57] ABSTRACT

The snow ski braking device comprises a bracket adapted to be mounted on the top face of the ski and having a pair of pivoted brake members straddling each side of the ski and biased to pivot downwardly to penetrate into the skiing surface when forward motion of the ski is arrested. Each brake member has a vertically oriented lower blade and a top horizontal paddle which cooperate to provide the desired braking action without interferring with the normally intended use of the ski.

14 Claims, 10 Drawing Figures

Fig-3
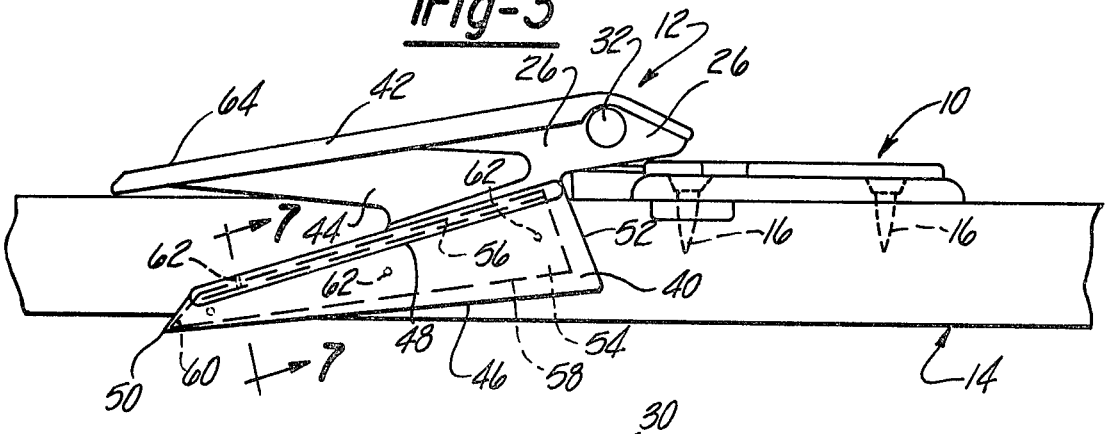
Fig-4
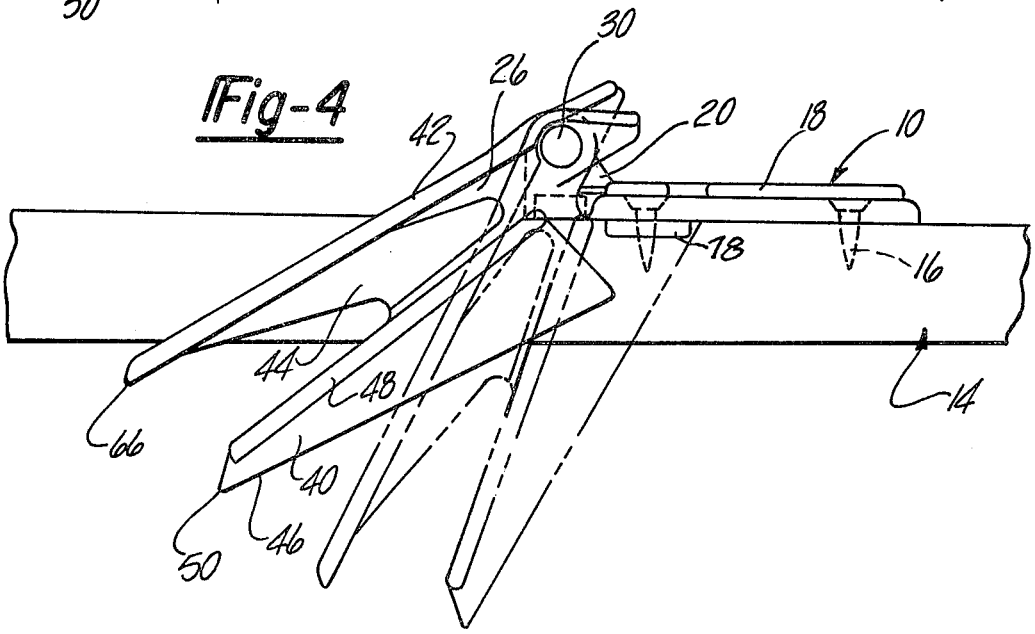
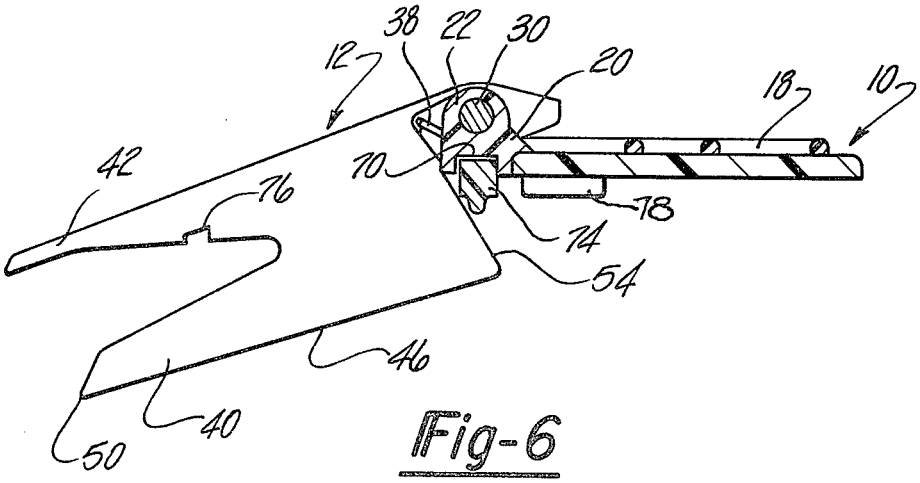
Fig-6

Fig-8
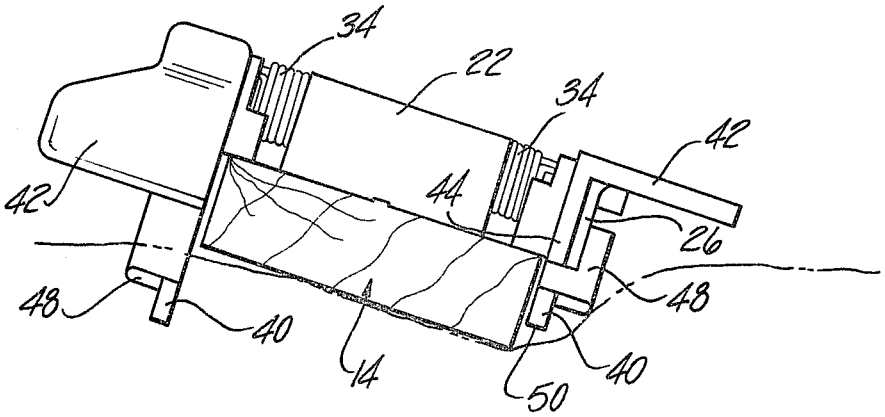
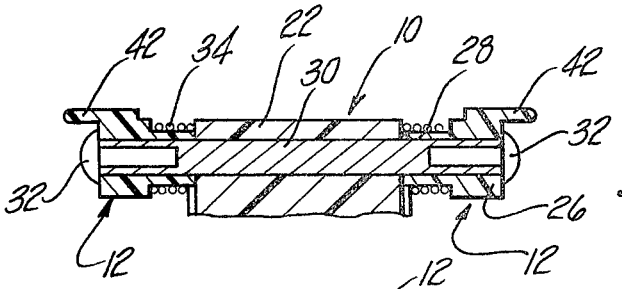
Fig-9
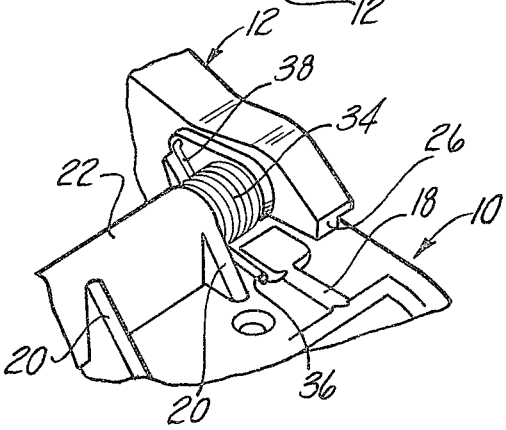
Fig-10

SKI BRAKING DEVICE

This invention relates to a snow ski braking device and, more particularly, to a device for preventing rearward movement of a snow ski, such as when climbing a hill.

The primary object of this invention is to provide a device of the type described which is of economical and sturdy construction.

Another object is to provide a device of this type which is extremely effective in preventing rearward movement of a snow ski and which, at the same time, produces very little drag to forward motion of the ski.

A further object of the invention is to provide a braking device for a snow ski which operates effectively to prevent rearward movement of a ski on all types of skiing surfaces encountered from soft snow to iced surfaces and which does not interfere with cornering or turning on the ski.

Further objects, features and advantages of the present invention will become apparent from the following description and accompanying drawings, in which:

FIG. 3 is a fragmentary side elevational view of a ski showing the braking device mounted thereon;

FIG. 4 is a view similar to FIG. 3 and showing various positions which the brake members of the device may assume;

FIG. 6 is a side elevational view partly in section showing the manner in which the retention clip illustrated in FIG. 5 may be used when the device is packaged for sale or shipment;

FIG. 8 is a sectional view through a ski rearwardly of the braking device showing the operation thereof when the ski is tilted for cornering or turning;

FIG. 9 is a sectional view along the line 9—9 in FIG. 2; and

FIG. 10 is a fragmentary perspective view of a portion of the device.

Figure 1:
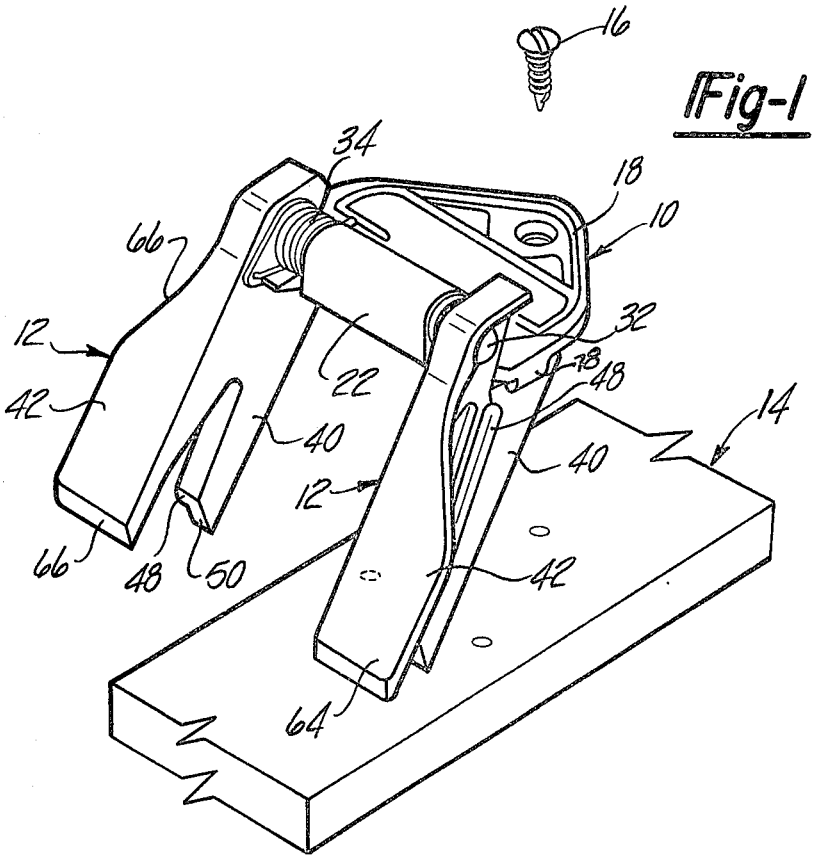
FIG. 1 is a perspective view of the braking device according to the present invention and illustrating the manner in which it is applied to a ski.
Figure 2:
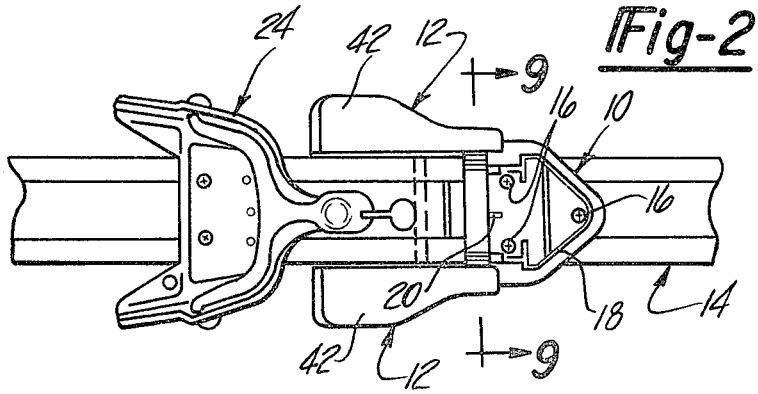
FIG. 2 is a fragmentary top plane view of a ski having the braking device of the present invention mounted thereon.
Figure 5:
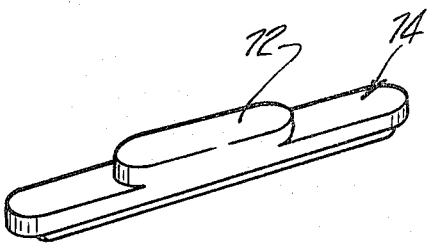
FIG. 5 is a perspective view of a retention clip which may be employed for packaging purposes or for retaining the brake members in a non-operative position when applied to the ski.

Referring first to FIGS. 1 and 2, the braking device of the present invention comprises a mounting plate 10 on which are supported a pair of brake members 12. As shown in FIG. 2, mounting plate 10 has a width at least slightly greater than the width of the ski 14 on which it is adapted to be mounted by three screws 16. The bottom side of mounting plate 10 is flat and the upper face thereof has upstanding reinforcing ribs thereon as indicated at 18 and 20. Plate 10 is preferably molded from a suitable tough plastic resin so as to be unaffected by the environment in which skis are used. Adjacent its rear end plate 10 is formed with a transversely extending boss 22 on which the brake members 12 are pivotally supported. As shown in FIG. 2, plate 10 is preferably mounted on ski 14 so that it is located just forwardly of the ski binding 24. If desired, a second braking device of the same construction can be mounted on the ski just rearwardly of the heal plate on the ski.

Each brake member 12 has a thickened vertical web portion 26 at its forward end. As shown in FIG. 9, the thickened web portion 26 has an integral bushing 28 on the inner side thereof which is pivotally mounted on a brass stud 30 extending transversely through boss 22 at the rear end of plate 10. The two brake members 12 are permanently secured in a pivoted manner on plate 10 by stainless steel rivets 32 in the ends of stud 30. Each of the brake members 12 is biased to pivot downwardly about stud 30 by means of a torsion spring 34. One end 36 of each spring 34 bears against the top side of plate 10 and the other end 38 of the spring 34 projects into an opening formed in the brake member as shown in FIG. 10.

Figure 7:
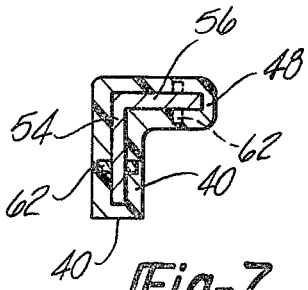
FIG. 7 is a fragmentary sectional view taken along the line 7—7 in FIG. 3.

Each brake member 12 is preferably molded from plastic and is formed with a thin vertically oriented blade 40 along its lower side. Blade 40 is connected with a top paddle 42 by means of a thickened web 26 and a thinner web section 44. Blade 40 has a generally straight lower edge 46 and along its upper edge the blade is molded with an integral laterally outwardly extending rib 48. As shown in FIG. 7, rib 48 projects laterally outwardly from the outer face of blade 40 a distance of about one and one-half times the thickness of blade 40. Rib 48 converges downwardly in a rearwardly direction toward the lower edge 46. The rear end of each blade 40 is rather sharply pointed as indicated at 50. At its forward end each blade 40 is provided with a straight edge 52 adapted to engage the underside of plate 10 at the laterally outer rear portions thereof to limit the extent to which the brake members 12 can pivot downwardly as shown in FIG. 4.

In order to reinforce the blade 40 (blade 40 has a thickness of only about $\frac{1}{8}''$), each brake member 12 is molded with a sheet metal insert 54 embedded in the blade 40. Insert 54 is generally L-shaped as shown in FIG. 7 so that it has a laterally outwardly extending flange 56 embedded in the rib 48. As is best shown in FIG. 3, insert 54 has a shape generally corresponding to the shape of blade 40, but is slightly smaller in size. The lower edge 58 of insert 54 is spaced above the lower edge 46 of blade 40 at the forward end thereof. However, the lower edge 58 inclines downwardly in a rearwardly direction so that at the rear pointed end 50 of blade 40 the pointed end 60 of insert 54 extends substantially to the lower edge 48 of the blade. Thus, after a minimum wear of the pointed end 50 of blade 40 the pointed end 60 of insert 54 is exposed. A plurality of small transversely extending pins 62 forms keying connections between insert 54 and blade 40.

Paddle 42 extends in a plane perpendicular to the vertical plane of blade 40. At its forward end the paddle 42 is reinforced by the thickened web portion 26 and rearwardly thereof the paddle is reinforced by the thinner web portion 44. As best shown in FIGS. 1 and 8, paddle 42 is relatively wide as compared to the thickness of blade 40. For example, the rectangularly shaped rear portion 64 of each paddle 42 has a width preferably on the order of about $1\frac{1}{8}''$. At the extreme rear end thereof, each paddle 42 is molded to have a somewhat sharp rear edge 66. Each paddle 42 preferably diverges in a rearward direction relative to each rib 48. Paddle 42 extends rearwardly from the pivot axis at stud 30 generally parallel to or slightly converging with the lower edge 46 of blade 40. The portion of each paddle 42 reinforced by the thickened web portion 26 has its width tapered as shown at 66 in FIG. 1 so that at their forward ends the paddles 42 are relatively narrow as compared with the wide rectangularly shaped rear ends 64 of the two paddles.

The described braking device is intended primarily for use on cross country skis. When the skier is travelling forwardly over packed snow, each brake member 12 will be biased by the springs 34 to generally the position shown in FIG. 3 wherein the rear pointed end of each blade 40 is disposed at a level at least slightly below the bottom face of the ski. If the skiing surface is light fluffy snow, then each brake member 12 would pivot downwardly to a greater extend and, if the skiing surface is glazed or iced, the pointed end 50 of each blade 40 would be disposed generally at the same level as the bottom face of the ski. In any event, whether the ski is on a glazed surface or is moving forward in fluffy lightly packed snow, the thinness of blade 40 prevents the device from producing a substantial drag to the forward movement of the ski. In light snow rib 48, which is substantially wider than the thickness of blade 40, will prevent the braking device from penetrating too deeply into the snow. If blades 40 penetrate too deeply they will interfere with easy turning. However, when climbing a hill there is a tendency for a ski to slide rearwardly. When the ski is provided with the braking device of this invention, as soon as it tends to slide rearwardly, the engagement of the pointed end 50 with the skiing surface causes the braking member 12 to pivot downwardly (counterclockwise as viewed in FIGS. 3 and 4) so that the pointed end 50 of blade 40 will penetrate deeper into the skiing surface. The extent to which the braking member 12 will pivot downwardly will depend to a large extent upon the inclination and the compactness of the skiing surface. Thus, under these various conditions the brake member 12 can pivot to any of the three positions illustrated in FIG. 4. In this connection it will be noted that each paddle 42 extends rearwardly beyond the rear pointed end 50 of blade 40. Thus, although the wide paddles 42 tend to prevent the blades 40 from penetrating too deeply into the snow when the skis are moving forwardly, as soon as the ski tends to slide rearwardly, the brake member 12 will pivot such as to cause the rear edge 66 of the paddle to dig firmly into the skiing surface and thus provide additional braking action for the pointed end 50 of the blade 40. Thus, depending upon the compactness of the skiing surface and the grade incline, the paddles 42 can penetrate into the skiing surface to a greater or lesser extent as shown by the three positions illustrated in FIG. 4 and, thus, provide the required braking action that prevents the ski from sliding rearwardly. If the skiing surface is glazed or iced, the rear pointed end 60 of insert 54 will dig into the glazed surface and prevent the ski from sliding rearwardly. Until the blades 40 become excessively worn, only a very small portion at the rear ends of inserts 54 will ever become exposed. When the ski moves forwardly from the braked position, the braking members 12 simply pivot upwardly.

Each of the braking members 12 is independently pivotable on the stud 30. The importance of this independent pivotal action of each braking member 12 is illustrated in FIG. 8. When the ski is tilted about its longitudinal axis as when cornering or turning, each of the braking members 12 acts independently of the other insofar as its depth of penetration into the skiing surface is concerned. Thus, the braking member on the inside of the turn, that is, on the low side of the incline, may penetrate only slightly while the braking member on the opposite side of the ski will penetrate to a substantially greater extent. However, both brake members are immediately responsive to a slight rearward sliding of the ski to dig into the skiing surface and thus prevent the ski from sliding backward to any large extent.

The underside of boss 22 is preferably molded with a generally rectangularly-shaped socket 70 adapted to receive a boss 72 on the top side of a retention clip 74. Clip 74 is of sufficient length so that when the boss 72 is engaged within the socket 70 the opposite end portions of the clip abut against the forward edges 52 of blades 40 so as to retain the brake members 12 in a locked, generally flat position to facilitate the packaging thereof (FIG. 6). The retention clip 74 may also be used for locking the brake members 12 in a generally horizontal position when the device is mounted on the ski by pivoting the brake members 12 upwardly and inserting the retention clip 74 between the upper face of the ski and the lower edge of the thin web portion 44. If desired, web portion 44 may be notched as at 76 (FIG. 6) to further insure retention of the brake members 12 in the locked generally horizontally extending position on the ski. When so locked on the ski, the rear pointed ends 50 of blades 40 are located above the bottom face of the ski.

Thus it will be seen that the braking device herein disclosed is admirably suited for the intended purpose. It it economically molded from plastic and, thus, requires a minimum of corrosion resistant metal parts. Although the device is formed of plastic, the metal inserts 54 impart the necessary strength and rigidity to the brake members 12. In the fully braked position the forward ends 54 of the blades bottom against the laterally outwardly extending edge portions of the rigid mounting plate which is reinforced on its top side by ribs 18, 20 and additionally reinforced at its laterally outer edges by the depending ribs 78. Ribs 78 are spaced apart a distance only slightly greater than the lateral spacing of the outer faces of blades 40. Therefore, the forward ends of the blades are prevented from spreading apart even under a heavy breaking load. Furthermore, it will be appreciated that the arrangement of the paddles 42 in combination with the thin blades 40 with the ribs 48 prevents the brake members from penetrating too deeply into the skiing surface and, nevertheless, provides an immediate and effective braking action when required regardless of the character of the skiing surface.

We claim:

1. A braking device for preventing rearward movement of a snow ski, such as when climbing a hill, comprising a plate adapted to be fixedly mounted on the upper face of a ski at generally the mid section thereof, a pair of laterally spaced brake members pivotally mounted on said plate so as to straddle the ski on which the plate is secured and pivot about a horizontal axis extending transversely of the ski, means biasing said brake members to pivot in a downward direction against the surface on which the ski is supported, each brake member comprising an upper paddle and a lower blade extending rearwardly from the pivot axis of the brake member in vertically spaced relation, said blade lying in a vertical plane and being relatively thin so as to readily penetrate into the surface on which the ski is supported and produce a minimum of drag to the forwardly moving ski, said paddle lying in a plane perpendicular to the blade and being relatively wide so as to restrict the penetration of the blade into the skiing surface when the ski is moving forwardly, the rear end of said blade being relatively sharp so as to readily dig into the skiing surface in response to a slight rearward movement of the ski, the length of said paddle being at least as great as the length of said blade.

2. A ski braking device as called for in claim 1 wherein the rear end of the paddle extends rearwardly beyond the rear end of said blade.

3. A ski braking device as called for in claim 1 wherein said plate and brake members are plastic moldings and said blade includes a thin vertically disposed sheet metal insert embedded therein, said insert being generally coextensive with said blade so as to impart rigidity thereto.

4. A ski braking device as called for in claim 1 wherein said blade has a lower edge extending forwardly from the rear sharp end thereof and a laterally outwardly extending rib spaced above said lower edge.

5. A ski braking device as called for in claim 4 wherein the plane of said rib is inclined to the plane of said paddle such that the rib and paddle diverge rearwardly from the pivot axis of the brake member.

6. A ski braking device as called for in claim 5 wherein the brake members are plastic moldings and including a thin L-shaped sheet metal insert embedded in each blade, said insert being generally coextensive with the blade and extending laterally into said rib.

7. A ski braking device as called for in claim 6 wherein said insert has a rear pointed end which extends substantially to the outer surface of the blade at the rear sharp end thereof so that with a minimum of wear of the plastic at the rear end of the blade said pointed end of the insert becomes exposed.

8. A ski braking device as called for in claim 5 wherein each brake member is a plastic molding and including a vertical reinforcing web extending downwardly from the bottom face of the paddle to said rib.

9. A ski braking device as called for in claim 8 wherein said web is shaped to define a generally rearwardly facing V-shaped opening between said paddle and said rib.

10. A ski braking device as called for in claim 1 wherein each of said brake members is mounted on said plate for independent pivotal movement.

11. A ski braking device as called for in claim 1 wherein said plate is dimensioned in width to project laterally outwardly beyond the opposite edges of the ski on which it is mounted and means on said brake members adapted to engage said laterally outwardly projecting portions of the plate to limit the extent to which the brake members can pivot downwardly on the plate member.

12. A ski braking device as called for in claim 11 wherein said last-mentioned means comprises the forward ends of said blades.

13. A ski braking device as called for in claim 1 wherein the blade and paddle are spaced apart vertically to provide an opening therebetween, said brake members being pivotable upwardly to a position wherein the opening is disposed at least in part above the plane of said plate so as to enable a locking member to be inserted therein on the upper face of the ski and thereby retain the brake members pivoted upwardly in a position wherein the pointed ends of the blades are disposed above the bottom face of the ski.

14. A ski braking device as called for in claim 12 including a reinforcing rib depending from each of the laterally outwardly extending portions of the mounting plate, said ribs being spaced laterally apart a distance only slightly greater than the lateral spacing between the outer faces of said blades at the forward ends thereof.

* * * * *